US005428435A

United States Patent [19]

Yasuda et al.

[11] Patent Number: 5,428,435

[45] Date of Patent: Jun. 27, 1995

[54] METHOD OF FORMING FIXED IMAGES USING ENCAPSULATED TONER

[75] Inventors: Shin-ichiro Yasuda, Osaka; Kuniyasu Kawabe; Mitsuhiro Sasaki, both of Wakayama, all of Japan

[73] Assignee: Kao Corporation, Tokyo, Japan

[21] Appl. No.: 234,605

[22] Filed: Apr. 28, 1994

Related U.S. Application Data

[63] Continuation of Ser. No. 956,415, Oct. 5, 1992, abandoned.

[30] Foreign Application Priority Data

Oct. 5, 1991 [JP] Japan ..... 3-285674

[51] Int. Cl.[6] ..... G03G 9/093

[52] U.S. Cl. ..... 355/295; 355/286; 355/279; 430/109; 430/124

[58] Field of Search ..... 355/282, 285, 286, 289, 355/290, 279, 287, 288, 326 M; 219/216, 469; 430/99, 109, 124, 98

[56] References Cited

U.S. PATENT DOCUMENTS

| | | | |
|---|---|---|---|
| 3,685,896 | 8/1972 | Kaupp | 355/279 |
| 3,810,735 | 5/1974 | Moser | 219/216 X |
| 3,997,790 | 12/1976 | Suzuki et al. | 250/319 |
| 4,448,872 | 5/1984 | Vandervalk | 430/126 |
| 4,795,689 | 1/1989 | Matsubara et al. | 430/99 |
| 4,937,167 | 6/1990 | Moffat et al. | 430/137 |
| 4,977,052 | 12/1990 | Mikami | 430/98 |
| 5,035,970 | 7/1991 | Hsieh et al. | 430/109 |
| 5,049,469 | 9/1991 | Pierce et al. | 430/109 |
| 5,057,875 | 10/1991 | Itoh | 355/279 |
| 5,213,934 | 5/1993 | Sacripante et al. | 430/109 |
| 5,225,308 | 7/1993 | Sasaki et al. | 430/138 |

FOREIGN PATENT DOCUMENTS

| | | |
|---|---|---|
| 0104627 | 4/1984 | European Pat. Off. . |
| 0453857 | 10/1991 | European Pat. Off. . |
| 59-214862 | 12/1984 | Japan . |
| 61-056352 | 3/1986 | Japan . |
| 0242978 | 10/1987 | Japan . |
| 0267660 | 10/1989 | Japan . |
| 0032368 | 2/1990 | Japan . |
| 0162355 | 6/1990 | Japan . |
| 0162356 | 6/1990 | Japan . |
| 02162355 | 6/1990 | Japan . |
| 2107892 | 5/1983 | United Kingdom . |

*Primary Examiner*—Robert B. Beatty

*Attorney, Agent, or Firm*—Birch, Stewart, Kolasch & Birch

[57] ABSTRACT

A method of forming fixed images includes charging a photoconductor; exposing the photoconductor to light; applying a thermally dissociating encapsulated toner, or an encapsulated toner whose shell is made of amorphous polyester to an electrostatic latent image formed on the photoconductor, developing the electrostatic latent image to form a visible image; transferring the formed visible image to a recording medium having a softening point of 100° C. to 200° C.; and fixing the transferred visible image onto the recording medium at a temperature of not less than 80° C. and not more than 120° C. by using a fixing roller which exerts a nip pressure of from 0.1 to 4.0 kg/cm.

11 Claims, 8 Drawing Sheets

METHOD OF FORMING FIXED IMAGES USING ENCAPSULATED TONER

This application is a continuation of application Ser. No. 07/956,415 filed on Oct. 5, 1992, now abandoned.

FIELD OF THE INVENTION

1. Background of the Invention

The present invention relates to an electrostatic energy system and more specifically to a method of forming fixed images produced from plain paper copying machines, laser printers, plain paper facsimiles, and the like.

2. Discussion of the Related Art

Conventionally, when images are formed with copying machines, laser beam printers, etc., the Carlson Method has been generally used (U.S. Pat. Nos. 2,221,776, 2,297,691 and 2,357,809, "Electrophotography," p22–p41, R. M. Shaffert, 1965, The Focal Press).

FIG. 2 shows a schematic view of an apparatus for a conventional method of forming fixed images. In the conventional method, after the electrostatic latent image formed on a photoconductor by optical means is developed in a developing process, it is transferred to a recording medium such as a recording paper in a transfer process and then fixed into the final image generally with heat and pressure in a fixing process. As the photoconductor is repeatedly used, a cleaning device is provided for cleaning the residual toner, after the transfer process, from the photoconductor with its rotation.

In the conventional method of forming fixed images, however, through the processes from the formation of the electrostatic latent image up to its fixing onto the recording medium, the temperature of the heating element of the fixing device has to remain at a very high level (usually around 200° C.) and further a relatively high pressure is required (usually between 2.0 and 6.0 kg/cm). On the other hand, since both the photoconductor and the developing device have to be maintained at around room temperature, a considerable distance has to be maintained between the fixing device and the developing device, which necessitates making the machine larger. In addition, it is necessary to force the removal of the heat generated from the system, but a noise produced by the forced radiation device is not negligible.

Further, in the conventional method of forming fixed images, since the fixing process is carried out independently and at such a high temperature of around 200° C., as mentioned above, expensive heat-resistant materials, such as heat-resistant resins, heat-resistant rubbers, etc. have to be provided around the fixing device.

When the fixing is carried out at a high temperature, the system is subject to problems such as curling and jamming of the paper. In addition, fixing failure may take place due to the heat absorbed by the paper, depending upon its thickness. In particular, in the case of using a transparency sheet as the recording medium, since the good heat resistance is required, those films whose softening points are not less than 220° C., such as polyethylene terephthalate films, polyimide films, and the like are normally used. Among them, the polyethylene terephthalate film having a melting point of about 260° C. and maximum available temperature of 150° C. is generally well used. However, this film is expensive. Also, since the film is used near the upper limit of the maximum available temperature, the film tends to curl depending on the placement of the film just after fixing, making it undesirable for use. In addition, the film is likely to cause problems, such as jamming with the fixing roller.

From these standpoints, the development of a novel method of forming fixed toner images as well as matching the toner resin thereto is in demand.

SUMMARY OF THE INVENTION

An object of the present invention is to provide a novel method of forming fixed images, wherein a recording medium having a softening point of 100° to 200° C. is used to provide advantageous results such as the reduction of curling and jamming of a transparency sheet, thus conserving in its maintenance.

Therefore, in an effort to solve the above-mentioned problems, the present inventors have investigated a toner shell material which is fragile to heat at a low temperature. As a result, they have found that a thermally dissociating encapsulated toner produced by interfacial polymerization, i.e., an encapsulated toner whose shell is made of an amorphous polyester melt at a temperature of not more than 120° C., can satisfy the requirements of the present invention.

More particularly, the method of forming fixed images of the present invention comprises charging a photoconductor exposing the photoconductor to light to produce an electrostatic latent image, applying a thermally dissociating encapsulated toner, or an encapsulated toner whose shell is made of amorphous polyester, to the electrostatic latent image formed on the photoconductor, thereby developing the electrostatic latent image to form a visible image, transferring the formed visible image to a recording medium and fixing the transferred visible image onto the recording medium at a temperature of not less than 60° C. and not more than 120° C., wherein the recording medium has a softening point of from 100° to 200° C.

As the above-mentioned recording medium, a polyethylene film, a polypropylene film, cellophane or a polymethylpentene film may be used. The nip pressure in the fixing process is maintained at 0.1 to 4 kg/cm.

According to the present invention, since the fixing temperature can be set extremely low using the thermally dissociating encapsulated toner or the encapsulated toner whose shell is made of amorphous polyester, in the case where a transparency sheet is used as a recording medium, a film whose softening point is low can be used. Moreover, since the fixing temperature is very low, problems such as curling and jamming of the recording medium are less likely to occur.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

Figure 1:
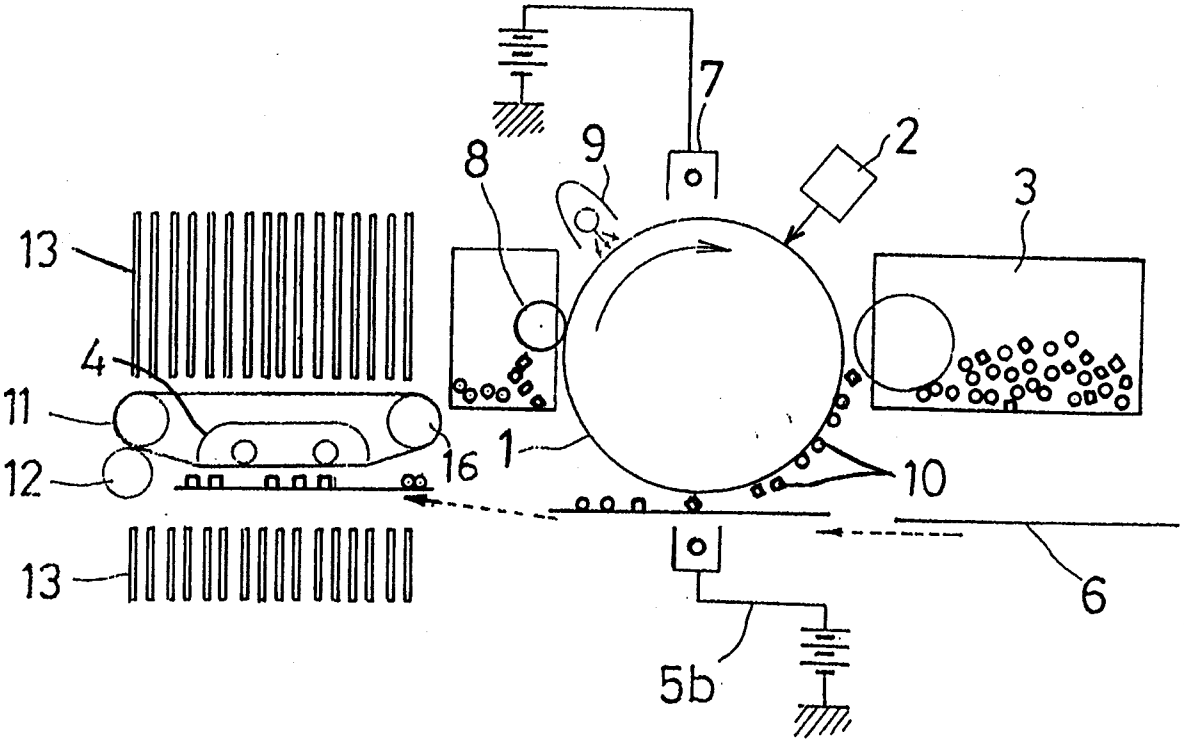
FIG. 1 is a schematic view showing one example of an apparatus used in the method of forming fixed images as defined by the present invention, in which the toner is preheated.
Figure 2:
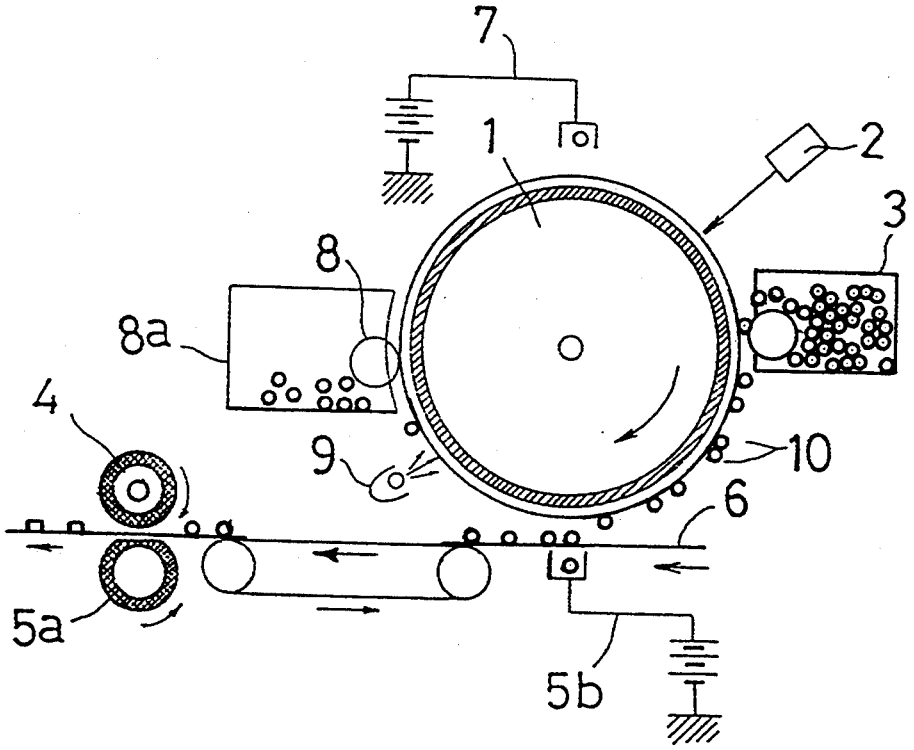
FIG. 2 PRIOR ART
FIG. 2 is a schematic view of an apparatus used for conventional methods of forming fixed images.

The reference numerals in FIGS. 1 through 10 denote the following elements:

Element 1 is a photoconductor, element 1*a* a photoconductive layer, element 1*b* a conductive support, element 2 an exposure device, element 3 a developer device, element 3*a* a rotating sleeve, element 4 a heater, element 5*a* a pressure roller, element 5*b* a transfer device, element 6 a recording medium, element 7 a charger, element 8 a cleaner device, element 8*a* a toner collecting box, element 9 a charge eraser, element 10 a toner, element 11 an endless film, element 12 a fixing roller, element 13 a radiator device, element 14 a heat roller, element 15 a conveyor belt, and element 16 a holding roller.

DETAILED DESCRIPTION OF THE INVENTION

The method of forming fixed images of the present invention is detailed below, referring to the drawings.

In the method of forming fixed images of the present invention, as long as it is a method wherein an image is formed by using a thermally dissociating encapsulated toner or an encapsulated toner whose shell is made of amorphous polyester having a fixing temperature of from 60° to 120° C. onto a recording medium whose softening point is 100° to 200° C., there are no limitations in the manner of carrying out the charging process, the exposing process, the developing process, the transfer process or the fixing process.

FIG. 1 is a schematic view showing one example of an apparatus used for the method of forming fixed images of the present invention.

A photoconductive drum wherein a photoconductive layer wherein a photoconductive layer such as amorphous silicon, selenium or an organic photoconductor is provided on a conductive support.

A charger 7 is arranged opposite to the photoconductor 1. The charging means is not particularly restricted, and any suitable charging means such as, for example, a corona charger, a brush charger, or a roller charger can be used.

An exposure device 2 is arranged opposite to the photoconductor 1 for forming an electrostatic latent image on the photoconductor surface. For an exposure device 2, light sources such as laser beams, LED or EL arrays, are used in combination with an image-forming optical system. Alternatively, a device based on optical systems projecting a reflected light of a document usually provided in the copying machine can be used.

A developer device 3 is arranged opposite to the photoconductor 1 for making visible the electrostatic latent image formed on the photoconductor with the toner. For a developer device, any of the commonly used two-component magnetic brush developer systems, the one-component magnetic brush developer systems, and the one-component non-magnetic developer device can be used.

The toner used in the present invention is a thermally dissociating encapsulated toner or an encapsulated toner whose shell is made of an amorphous polyester. The thermally dissociating encapsulated toner means a toner which comprises a shell whose structure is fragile to heat, and a thermoplastic core material containing at least a thermoplastic resin and a coloring agent which can be fixed at a low temperature by pressure. Alternatively, the encapsulated toner whose shell is made of amorphous polyester, means a toner coated on the surface of a thermoplastic core material containing at least a thermoplastic resin and a coloring agent, with an amorphous polyester obtainable by a condensation polymerization between at least one alcohol monomer selected from the group consisting of dihydric alcohol monomers and trihydric or higher polyhydric alcohol monomers and at least one carboxylic acid monomer selected from the group consisting of dicarboxylic acid monomers and tricarboxylic or higher carboxylic acid monomers. More particularly, the shell structure of these toners changes with heat, and at the point where pressure is applied, the core material is discharged to effect the fixing of the toner.

Such encapsulated toners can be obtained usually by the following production methods.

(1) A spray-drying method, wherein after the core material is dispersed in a non-aqueous solution of polymer or polymer-emulsion, the dispersed liquid is spray-dried.

(2) A phase separation method (coacervation method), wherein phase separation is conducted around the core material in a solution of ionic polymer colloids and the core material, so that a simple emulsion is first prepared, which in turn is converted to a complex emulsion, in which the core materials are micro-encapsulated;

(3) An interfacial polymerization method, wherein a core material solution or dispersion is dispersed in a water in oil or oil in water type emulsion system, while at the same time collecting the shell material monomers (A) around the surfaces, which in turn is followed by reacting monomers (A) with monomers (B) around the surfaces in the subsequent step; and (4) Other methods which include an in situ polymerization method, a submerged cure coating method, an air suspension coating method, an electrostatic coalescing method, a vacuum vapor deposition coating method, etc.

In the present invention, the particularly preferred encapsulated toners include a thermally dissociating encapsulated toner produced by the interfacial polymerization method or the spray-drying method, and an encapsulated toner whose shell is made of amorphous polyester produced by the in situ polymerization method. The interfacial polymerization method and the in situ polymerization method not only have the merit of an easy function separation for the core material and shell material but also are capable of producing a uniform toner in an aqueous state. Moreover, substances of low softening points can be used for the core material in these polymerization methods, making it particularly suitable from the aspect of fixing ability of the toner.

For shell materials, styrene resins (Japanese Patent Laid-Open No.205162/1983), polyamide resins (Japanese Patent Laid-Open No.66948/1983), epoxy resins (Japanese Patent Laid-Open No.148066/1984), polyurethane resins (Japanese Patent Laid-Open No.179860/1982), polyurea resins (Japanese Patent Laid-Open No.150262/1987) and many others have been proposed. As substances fixable under heat and pressure contained in the core material, thermoplastic resins such as polyester resins, polyamide resins, polyester-polyamide resins and polyvinyl resins whose glass transition points (Tg) are not less than 10° C. and not more than 50° C. can be used.

As compared to the thermal properties of the core material, the structure and the thermal properties of the shell material concern themselves remarkably with the fixing ability of the whole toner. Since a particular polyurethane resin among the above-mentioned resins for the shell materials is thermally dissociating, having excellent storage stability and fixing ability at a low temperature, it is an extremely favorable shell material for the thermally dissociating encapsulated toner of the present invention. The principal components of such a shell material include resins having at least one linkage selected from the group consisting of thermally dissociating urethane linkage, thiol urethane linkage and s-thiourethane linkage. Particularly, in the thermally dissociating urethane resin which is the principal components of the shell material, at least 30% of all of the linkages formed from the isocyanate and/or isothiocyanate groups are thermally dissociating linkages. For instance, resins obtainable from the reaction between an isocyanate compound and/or isothiocyanate compound and compounds containing a phenolic hydroxyl group and/or a thiol group are preferably used (EP04538-57A).

More particularly, the thermally dissociating encapsulated toner suitably used in the present invention can be produced by any known methods such as interfacial polymerization, etc., and this encapsulated toner is composed of a heat-fusible core material containing at least a coloring agent and a shell formed thereon so as to cover the surface of the core material, wherein the main components of the shell are a resin prepared by reacting:

(A) an isocyanate and/or isothiocyanate compound comprising:

(1) 0 to 30 mol % of a monovalent isocyanate and/or isothiocyanate compounds, and (2) 100 to 70 mol % of at least a divalent isocyanate and/or isothiocyanate compounds with (B) an active hydrogen compound comprising:

(3) 0 to 30 mol % of a compound having one active hydrogen atom reactive with isocyanate and/or isothiocyanate groups, and (4) 100 to 70 mol % of a compound having at least two active hydrogen atoms reactive with isocyanate and/or isothiocyanate groups at a molar ratio of the component (A) to the component (B) of between 1:1 and 1:20, and wherein at least 30% of all of the linkages formed from the isocyanate or isothiocyanate groups are thermally dissociating linkages.

According to the present invention, the thermally dissociating linkage is preferably one formed by the reaction between a phenolic hydroxyl and/or thiol group and an isocyanate and/or isothiocyanate group.

The resins to be used as core materials of the encapsulated toner according to the present invention are thermoplastic resins having glass transition points (Tg) of 10° to 50° C., and such encapsulated toner of the present invention having a softening point of 80° to 150° C. can be used.

In the encapsulated toner whose shell is made of amorphous polyester, the amorphous polyester can be obtained by condensation polymerization between at least one alcohol monomer selected from the group consisting of dihydric alcohol monomers and trihydric or higher polyhydric alcohol monomers and at least one carboxylic acid monomer selected from the group consisting of dicarboxylic acid monomers and tricarboxylic or higher carboxylic acid monomers. (Japanese patent application filed on Sep. 1, 1992; Identification number: KAP92-0894)

Examples of the dihydric alcohol components include bisphenol A alkylene oxide adducts such as polyoxypropylene(2.2)-2,2-bis(4-hydroxyphenyl)propane, polyoxypropylene(3.3)-2,2-bis(4-hydroxyphenyl)propane, polyoxypropylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A, a bisphenol A propylene adduct, a bisphenol A ethylene adduct, hydrogenated bisphenol A and other dihydric alcohols.

Examples of the trihydric or higher polyhydric alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and other trihydric or higher polyhydric alcohols.

In the present invention, these dihydric alcohol monomers and trihydric or higher polyhydric alcohol monomers may be used singly or in combination.

As for the acid components, examples of the dicarboxylic acid components include maleic acid, fumaric acid, citraconic acid, iraconic acid, glutaconic acid, phthalic acid, isophthalic acid, terephthalic acid, succinic acid, adipic acid, sebacic acid, azelaic acid, malonic acid, n-dodecenylsuccinic acid, n-dodecylsuccinic acid, n-octylsuccinic acid, isooctenylsuccinic acid, isooctylsuccinic acid, and acid anhydrides thereof, lower alkyl esters thereof and other dicarboxylic acids.

Examples of the tricarboxylic or higher carboxylic acid components include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Empol trimer acid and acid anhydrides thereof, lower alkyl esters thereof and other tricarboxylic or higher carboxylic acids.

In the present invention, these dicarboxylic acid monomers and tricarboxylic or higher carboxylic acid monomers may be used singly or in combination.

More particularly, the encapsulated toner whose shell is made of amorphous polyester suitably used in the present invention can be produced by any known methods such as in situ polymerization, and this encapsulated toner is composed of a heat-fusible core material containing at least a thermoplastic resin and a coloring agent, and a shell formed thereon so as to cover the surface of the core material.

The resins to be used as core materials of the encapsulated toner according to the present invention are thermoplastic resins having glass transition points (Tg) of 10° to 50° C., and examples thereof include polyester resins, polyester-polyamide resins, polyamide resins and polyvinyl resins, among which polyvinyl resins are particularly preferable. When the glass transition point (Tg) is less than 10° C., the storage stability of the resulting encapsulated toner is undesirably poor, and when it exceeds 50° C., the fixing strength of the encapsulated toner is undesirably poor.

The method of producing the encapsulated toner by the in situ polymerization is detailed below.

In this production method, a shell is formed based on the principle that the concentration of the shell material on the surface of the droplets takes place in a mixture solution containing a core material and a shell material comprising amorphous polyester, which mixture solution is dispersed in a dispersion medium. Specifically, the separation of the core material and the shell material takes place in the droplets of the mixture solution due to the differences in the indices of solubility. In this state, the polymerization progresses to form an encapsulated structure. By this method, since a shell is formed into a layer containing amorphous polyester in a substantially uniform thickness, the chargeability of the toner becomes uniform.

In the case of producing the encapsulated toner by the in situ polymerization method, a dispersion stabilizer is required to be contained in the dispersion medium in order to prevent agglomeration and incorporation of the dispersed substances.

Examples of the dispersion stabilizers include polyvinyl alcohol, sodium dodecylbenzenesulfonate, and tricalcium phosphate.

Examples of the dispersion media of the dispersion stabilizer include water, methanol, ethanol, propanol, butanol, ethylene glycol, glycerol, isopropyl ether and tetrahydrofuran. These dispersion media can be used singly or in combination.

The addition amount of the amorphous polyester is normally 3 to 50 parts by weight, preferably 5 to 40 parts by weight, based on 100 parts by weight of the core material. When it is less than 3 parts by weight, the resulting shell becomes too thin, thereby making the storage stability of the toner poor, and when it exceeds 50 parts by weight, the resulting mixture becomes highly viscous, posing difficulty in making the powder fine, thereby leading to poor production stability of the toner.

The amorphous polyester suitably used in the present invention has a glass transition point of 50° to 80° C., and an acid value of 3 to 50 KOH mg/g. The resins to be used as core materials of the encapsulated toner are thermoplastic resins having glass transition points of 10 to 50° C.

Such kind of encapsulated toners applied to the electrostatic latent image formed on the photoconductor is transferred by the transfer device **5*b* to the recording medium 6**. Known as transfer methods are a corona transfer method, wherein corona ions are supplied to the reverse side of the recording medium, a roller transfer method, wherein a transfer electric field is formed by voltage generated by pressing a conductive roller, to which a voltage is applied, against the reverse side of the recording medium, and an induction belt transfer method, wherein an inductive belt serves to convey the recording medium, etc and all of these methods are applicable to the present invention.

The cleaner device 8, such as a cleaning web for removing trace amounts of the toner remaining on the photoconductor after the transfer process, is arranged opposite to the photoconductor 1.

Figure 7:
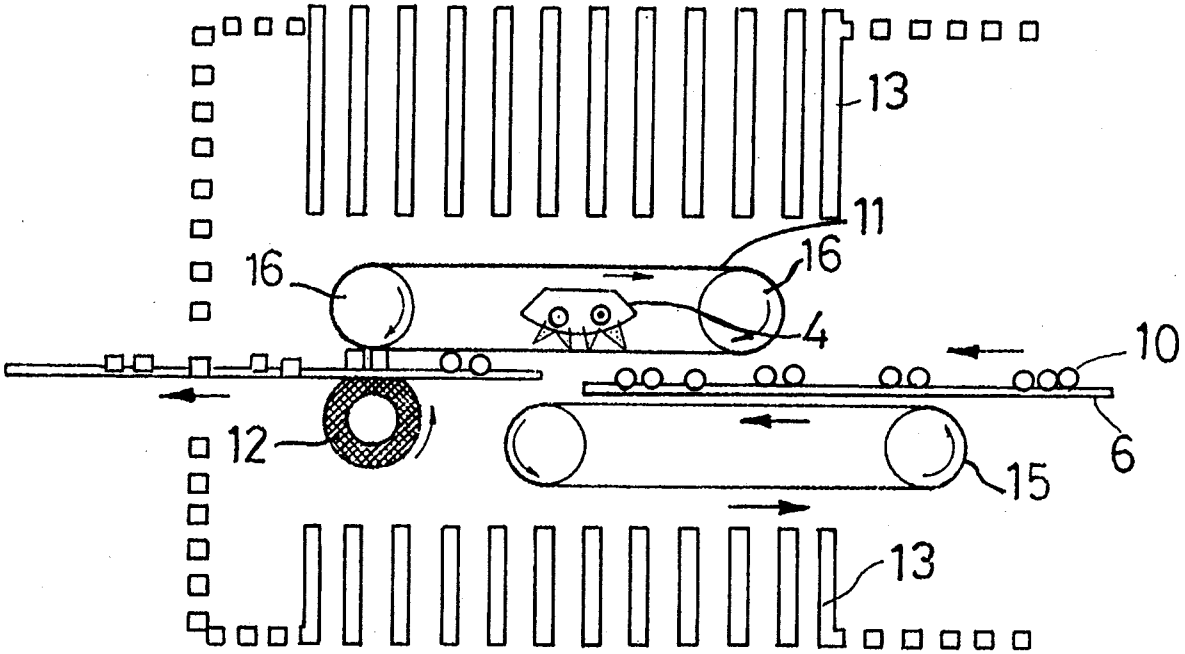
FIG. 7 is a schematic view of the fixing process in the method as defined by the present invention, in which a heater through an endless film is used as a heat source.
Figure 8:
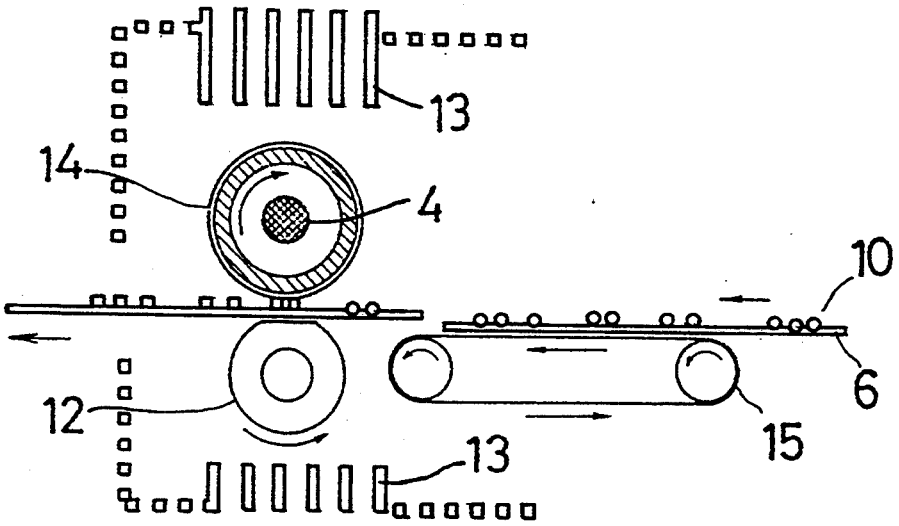
FIG. 8 is a schematic view of the fixing process in the method as defined by the present invention, in which a heat roller is used as a heat source.

As shown in FIGS. 1 and 7, a method in which fixing takes place by preheating the toner transferred onto the recording medium in advance of fixing and applying pressure to the toner at the fixing portion may be utilized. In this case, the fixing device is provided with a heater 4, a fixing roller 12, holding rollers 16 and an endless film 11. Alternatively, as shown in FIG. 8, a conventionally known method using a heat roller may be used. In this case, a heat roller 14 in which a heater 4 is incorporated is provided along with a fixing roller 12.

As shown in FIGS. 1 and 7, when the toner-preheating method is used, the heater 4 is arranged above and near the conveying route of the recording medium, so that it can preheat the surface of the toner transferred onto the recording medium through the endless film in order to fix the toner. As long as the film surface can be heated up to 120° C., any type of heat source can be used for the heater 4. Further, the endless film can be of a type which generates heat when electricity is conducted therethrough, in which case, the heater 4 is no longer required. For a heating body of the heater 4, heat sources such as a hot plate, a quartz heater, a flash heater, a heating belt, a heating element, etc. can be used.

Since the heating temperature can be set at a low level, the endless film is not confined to heat-resistant films such as fluoro-resins, polyimide resins, polyamide resins, polyester resins, and includes non-heat resistant films such as polypropylene films, polyethylene films, cellophane, etc. The endless film is stretched with at least two holding rollers 16.

The fixing roller 12 is a means for fixing the transferred toner image by pressurizing the recording medium having the transferred toner image against the endless film surface and is used as a pressure roller. As fixing takes place in the case of ordinary fixing devices at a high temperature, a heat resistant material such as a heat-resistant silicone rubber, which shows heat resistance at a temperature of not less than 240° C. must be used for the fixing roller. However, since the fixing roller in contact with the reverse side of the recording medium is not directly heated, and the temperature of the toner surface which is preheated by the heater 4 rises at most to only 120° C., the temperature transmitted to the fixing roller is very low. Therefore, a high heat resistance is not required for the fixing roller. Accordingly, as long as it is an elastic body having a softening point of not less than 120° C., there are no limitations on its material, and any of the ordinary inexpensive elastic materials can be used. Further, since such a low nip pressure of less than 4 kg/cm is applicable to a fixing device in the present invention, the durability of the fixing roller becomes longer.

As shown in FIG. 8, when a heat roller is used for fixing, since the fixing takes place at a high temperature (around 200° C.) in the case of a conventional device, heat-resistant resins such as fluoro-resins, polyimide resins, polyamide resins, and polyamide-imide resins are used for the fixing portion, which can be exemplified by an aluminum cylinder coated with Teflon. In the present invention, since the fixing temperature is not more than 120° C., the use of the conventional heat-resistant films makes the durability of the heat roller longer. In addition, non-heat-resistant films such as those of polyester resins, polypropylene resins, polyethylene resins and cellophane can be used. The fixing roller 12 which is used together with the heat roller serves as a pressure roller as in the case of using the endless film, and as long as it is an elastic body having a softening point of not less than 120° C., there are no limitations on its material, and any ordinary inexpensive elastic material can be used. Further, since its nip pressure is less than 4 kg/cm in the present invention, the durability of the fixing roller becomes longer.

The recording paper 6 used as a recording medium is, for instance, as shown in FIG. 7, transported to the fixing device by the conveyor belt 15 along the surface of the endless film 11, while being preheated by the heater 4 through the endless film and onto which the toner image has been transferred. The recording paper 6 is then inserted between the fixing roller 12 and the holding roller 16 through the endless film 11 to fix the visible image and discharged out of the apparatus by a paper discharging means not illustrated in the figure. Alternatively, as shown in FIG. 8, the visible image on the recording medium transported by the conveyor belt 15 is fixed by pressing and heating between the heat roller 14 and the fixing roller 12, and the recording medium is then discharged.

In the present invention, since the fixing temperature is low, when a transparency sheet is used as a recording medium, films having considerably low softening points, for instance, of 100° to 200° C. can be advantageously used. The films having such low softening points include resin films such as polyethylene films, polypropylene films, cellophane, polymethylpentene films, etc., whose cost can be remarkably reduced when compared to the conventional materials for a recording medium.

In FIGS. 1, 7 and 8, element 13 is a radiator, and instead of a forced radiating apparatus such an electric fan as used conventionally, a honeycomb-type apparatus can be used in the present invention. The apparatus has a cross-section in any form including a square, a rectangle, a parallelogram, a regular hexagon, etc. The radiator 13 serves to radiate the heat generated in the fixing section, and is so arranged that the air stream may flow vertically from below to above and facilitate radiation. Its material can be of metal plates such as aluminum plates, stainless steel plates, etc. or plastic plates such as acrylic resin plates, bakelite plates, etc. Since the fixing temperature is low in the present invention, a sufficient radiation is facilitated if the honeycomb-type radiator as mentioned above is provided.

The photoconductor 1, the endless film 11, the heat roller 14 and the fixing roller 12 are rotated by specified driving means not illustrated in the figures in the direction shown in the respective drawings at fixed peripheral speeds.

Next, the individual processes of the method of forming fixed images by the present invention having the above-mentioned construction will be described.

Figure 3:
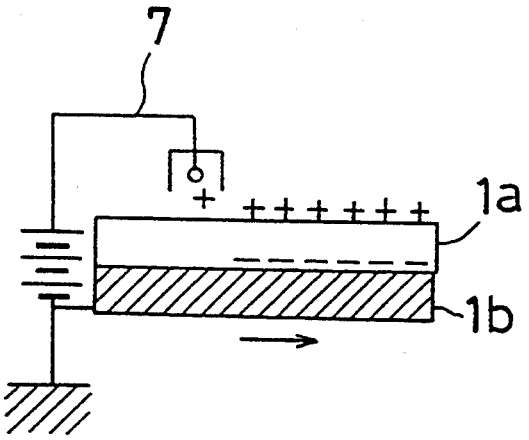
FIG. 3 is a schematic view showing the charging process in the method as defined by the present invention.
Figure 4:
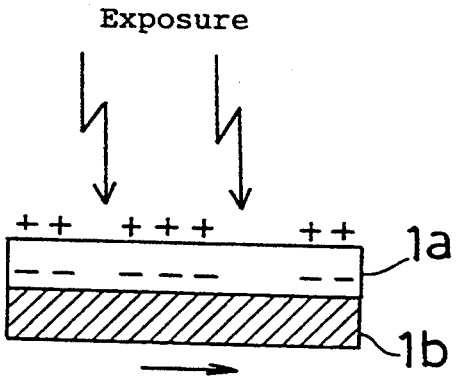
FIG. 4 is a schematic view showing the exposing process in the method as defined by the present invention.
Figure 5:
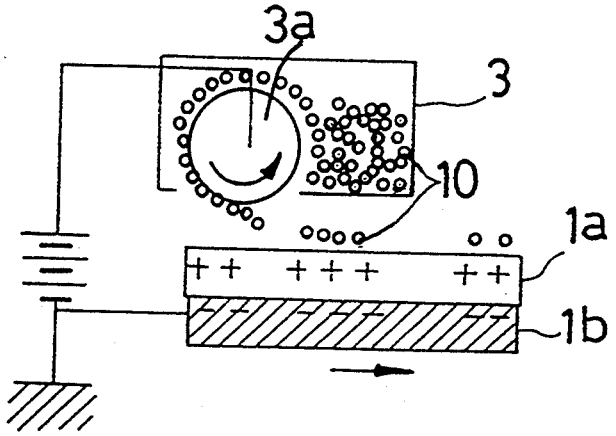
FIG. 5 is a schematic view showing the developing process in the method as defined by the present invention.
Figure 6:
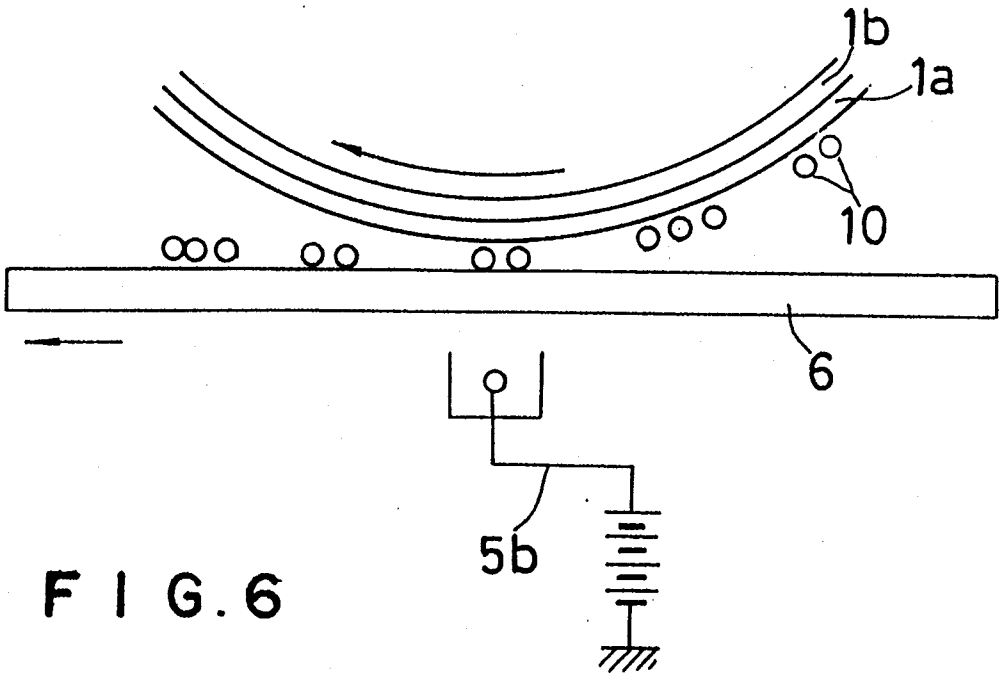
FIG. 6 is a schematic view showing the transfer process in the method as defined by the present invention.

FIG. 3 shows a charging process, FIG. 4 an exposing process, FIG. 5 a developing process, FIG. 6 a transfer process and FIGS. 7 and 8 fixing processes.

In the charging process, as shown in FIG. 3, a specified charge is uniformly supplied, e.g. by the corona charger 7, to the photoconductor surface. A photoconductor sensitive to a positive charge is taken here for an example, and the surface of the conductive supporter **1*b* is coated with the photoconductive layer 1*a* to form the photoconductor 1. A uniform charge is applied by the corona charger 7 to the photoconductive layer 1*a*, thereby positively charging the surface of the photoconductive layer 1*a***.

In the exposing process, as shown in FIG. 4, a light from the exposure device 2 is irradiated to the surface of the photoconductor, so that a leakage of charge occurs only in the exposed parts to form an electrostatic latent image on the photoconductive layer **1*a***.

In the developing process, as shown in FIG. 5, the toner triboelectrically charged inside the developer device is transported by the rotating sleeve **3*a*, and developed onto the photoconductor surface in proportion to the charge on the photoconductor surface. The developing process is an assortment of normal development in which a reversely polarized toner adheres to the charges by the Coulomb's force and of reverse development in which the toner adheres to the charges lost due to exposure to the light. The development process in the present invention applies to either method, but the case of the normal development is illustrated in FIG. 5**.

In the transfer process, as shown in FIG. 6, the visible image on the photoconductor surface accepts the charges from the reverse side of the recording medium 6, such as the recording paper, through a transfer-corotron or a transfer-roller, and it is then transferred to the recording medium 6. Part of the toner is left behind untransferred on the photoconductor surface, which is removed by the cleaning device 8 such as a cleaning web, which is arranged opposite to the photoconductor, as shown in FIG. 1.

In the fixing process, when an endless film is used, as shown in FIG. 7, the visible image transferred on the surface of the recording medium 6 is preheated without any contact by the heater 4 through a transparent endless film 11, and the visible image is then pressed by inserting the recording medium 6 between the fixing roller 12 and the holding roller 16 through the endless film 11 to fixed onto the recording medium 6 more firmly. Alternatively, when the heat roller is used, as shown in FIG. 8, the visible image is fixed onto the recording medium 6 by applying pressure while passing between the heat roller 14 and the fixing roller 12.

In either case where an endless film is used or where a heat roller is used, in order to fix the toner transferred on the recording medium, such as a recording paper, etc., it is heated within the temperature range of normally between 60° C. and 120° C. in the present invention. When the heating temperature is less than 60° C., the melting of the toner becomes undesirably insufficient, and when it exceeds 120° C., the fixing temperature becomes too high, posing problems incurred by the conventional methods as mentioned above.

In the case of the conventional methods, the nip pressure in the fixing process has to be made higher, as the fixing temperature is made lower, meaning that a nip pressure of not less than 4 kg/cm is required. However, in the present invention, although the fixing temperature is set to be no more than 120° C., a sufficient fixing strength can be obtained with a nip pressure of 0.1 to 4 kg/cm, and even less than 2 kg/cm, in many cases. Moreover, in general, when the temperature applied to the surface of the recording medium is too high, the recording paper tends to curl. When it is too low, the fixing of the toner becomes insufficient, making record preservation difficult. Therefore, since the fixing can be carried out in the temperature range of 60° C. to 120° C. in the present invention as mentioned above, such problems are not likely to take place.

On the other hand, the charges remaining on the photoconductor 1 after the developing process and the transfer process are over are neutralized by a charge eraser 9 such as a charge erasing lamp into a reusable state again for the charging process.

Figure 9:
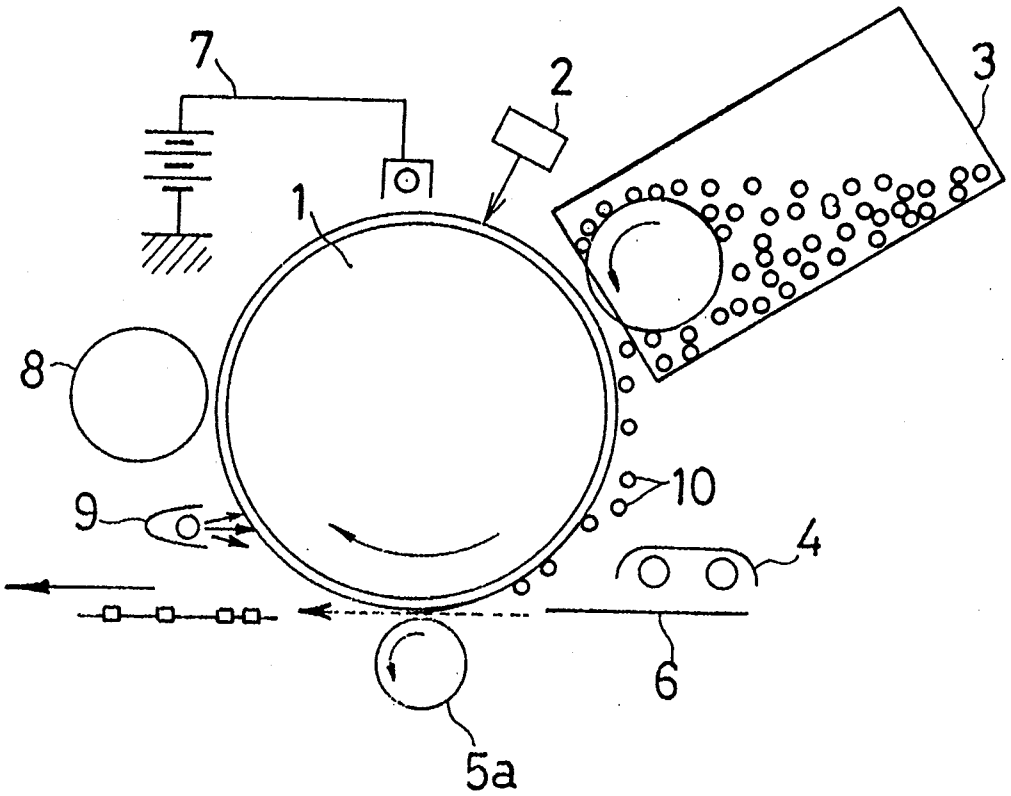
FIG. 9 is a schematic view showing one example of an apparatus used in the method of forming fixed images as defined by the present invention, in which the recording medium is preheated.

In the present invention, other than the cases where the toner is preheated or where the heat roller is used, by utilizing the properties of the thermally dissociating encapsulated toner or the encapsulated toner whose shell is made of amorphous polyester in the present invention, fixing takes place by simultaneously carrying out the transfer process and the fixing process on the surface of the photoconductor. A schematic view of the method of forming fixed images of this case is shown in FIG. 9.

In this method, the transfer and fixing are simultaneously carried out on the photoconductor by using a recording medium normally preheated to a temperature of 60° to 160° C., with heat retained on the recording medium supplied in advance and pressure applied through from the pressure roller.

Specifically, this method is a method in which the recording medium is preheated. As shown in FIG. 9, element 4 is a heater, and element 5*a* is a pressure roller, and the heater 4 is arranged just before the point where the photoconductor 1 contacts the pressure roller 5*a*, so that the preheated recording medium can be conveyed to the pressure roller. The heater 4 is a device for preheating the surface of the recording medium such as a recording sheet, etc., wherein the surface comes in contact with the toner. As long as it is a device capable of heating the surface of the recording medium up to 160° C., any type of heat source can be used for the heater 4. Heating bodies of the heater 4 include, for example, a hot plate, a quartz heater, a flash heater, a heating belt, a heating element, etc., with preference given to the quartz heater and the heating element. The pressure roller 5*a* is means for pressure-welding the preheated recording medium 6 onto the surface of the photoconductor. In an ordinary fixing device, it is necessary to use heat-resistant silicone rubbers, etc. in order to carry out fixing at a high temperature. However, in the present invention, it is not required to use the pressure roller having a particularly high heat resistance, since the pressure roller in contact with the reverse side of the preheated recording medium is not directly heated, and the temperature transmitted to the pressure roller is remarkably low. Therefore, as long as the materials for the pressure roller are elastic bodies having a good heat resistance at not less than 150° C., there are no limitations on its materials, and any of the ordinary inexpensive elastic materials including, for instance, heat-resistant polyurethane resins, acrylic resins, nitrile resins and non-conjugated diene terpolymer resins such as EPDM can be used. Incidentally, in the present invention, a belt may be used as a similar means in the place of the pressure roller.

Figure 10:
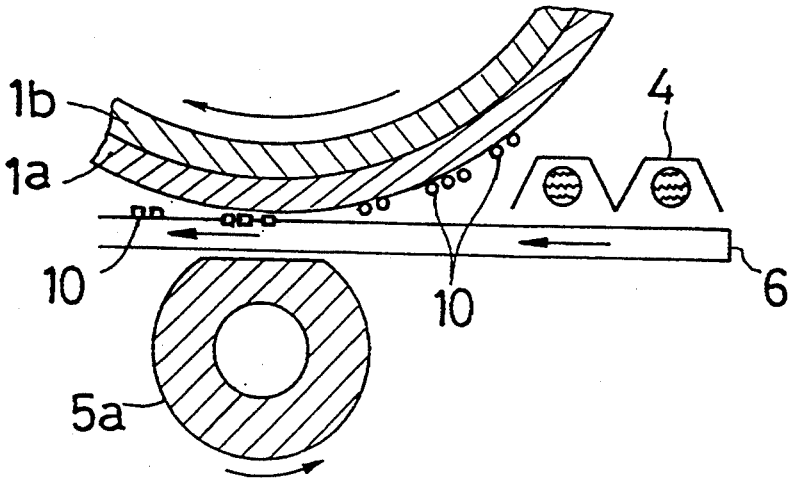
FIG. 10 is a schematic view showing the transfer and fixing process in the method as defined by the present invention, in which the recording medium is preheated.

In the transfer and fixing process, as shown in FIG. 10, the visible image formed by applying the toner to adhere to a latent image on the surface of the photoconductor is conveyed. At the same time, a recording medium 6, such as a recording paper preheated by a heater 4, is pressure-welded onto the surface of the photoconductor by pressing the reverse side of the recording medium by a pressure roller 5*a*, synchronizing with the initial end of the visible image, and thereby the visible image is simultaneously transferred and fixed onto the recording medium 6. In other words, when the toner adhered to the latent image formed on the surface of the photoconductor is pressure-welded to the recording medium, the deformation of the shell structure of the encapsulated toner due to the heat held in the recording medium takes place at the same time with the discharging of the core material in the encapsulated toner due to pressure of the pressure roller. When the temperature applied to the surface of the recording medium by the heater 4 is too high, the recording paper tends to curl, and when it is too low, sufficient fixing of the toner cannot be undesirably achieved, making record preservation difficult. Therefore, the surface of the recording medium is usually heated to a temperature of between 60° C. and 160° C., preferably between 60° C. and 120° C. In this case, the nip pressure of the pressure roller is usually 0.1 to 4.0 kg/cm as in the method in which the toner is preheated or the heat roller method to achieve sufficient fixing strength.

In the transfer and fixing method, since substantially all of the toner is transferred to the recording medium, a toner collecting device is not required. Incidentally, although trace amounts of the toner may remain on the surface of the photoconductor 1 after the transferring of the toner to the recording medium 6, this toner can be removed by pressure-welding the photoconductor with such devices as a cleaning web arranged opposite to the photoconductor, making it possible to repeatedly use the photoconductor.

Further, when the transfer and fixing process is completed, the charges remaining on the photoconductor are neutralized by a charge eraser 9 such as a charge erasing lamp arranged opposite to the photoconductor 1, so that the photoconductor 1 can be reused for the charging process.

In addition, the present invention is not confined to the above-mentioned embodiments, and specifications of the kinds of individual apparatus, processes etc. can be revised based on the principles of the present invention.

According to the method of forming fixed images of the present invention, since the fixing can be carried out at a fixing temperature of not less than 120° C., when particularly a transparency sheet is used, a recording medium having a low softening point can be used, making it possible to use inexpensive materials. In addition, the fixing temperature is thus low and the nip pressure can also be lowered, curling of the recording medium is less likely to take place, thereby making it less likely to cause jamming of the transparency sheets. Therefore, its maintenance is conserved.

PREFERRED EMBODIMENTS

The present invention is hereinafter described by means of the following working examples, which are intended to illustrate, but not limit, the scope of the present invention.

Production Example 1 of Encapsulated Toner

To a mixture comprising 70.0 parts by weight of styrene, 30.0 parts by weight of 2-ethylhexyl acrylate and 1.0 part by weight of divinylbenzene, 10.0 parts by weight of carbon black "#44" (manufactured by Mitsubishi Kasei Corporation), 4.0 parts by weight of 2,2'-azobisisobutyronitrile, 9.5 parts by weight of 4,4'-diphenylmethane diisocyanate "Millionate MT" (manufactured by Nippon Polyurethane Industry Co., Ltd.) are added. The obtained mixture is introduced into an attritor (manufactured by Mitsui Miike Kakoki) and dispersed at 10° C. for 5 hours to give a polymerizable composition. This composition is added to 800 g of a 4% by weight aqueous colloidal solution of tricalcium phosphate which had been preliminarily prepared in a two-liter separable glass flask, so as to give a concentration of 30% by weight. The obtained mixture is emulsified and dispersed with a TK homomixer (manufactured by Tokushu Kika Kogyo) at 5° C. and a rotational speed of 10000 rpm for 2 minutes. A four-necked glass cap is set on the flask, and a reflux condenser, a thermometer, a dropping funnel fitted with a nitrogen inlet tube and a stainless steel stirring rod are attached thereto. The resulting flask is placed on an electric mantle heater. A solution of 22.0 g of resorcinol, 3.6 g of diethyl malonate and 0.5 g of 1,4-diazabicyclo[2.2.2]octane in 40 g of ion-exchanged water is prepared, and the resulting mixture is dropped into the flask in a period of 30 minutes through the dropping funnel while stirring. Thereafter, the contents are heated to 80° C. and reacted for 10 hours in a nitrogen atmosphere while stirring. After cooling the reaction mixture, the dispersing agent is dissolved into 10%-aqueous hydrochloric acid. The resulting mixture is filtered and the obtained solid is washed with water, dried under a reduced pressure of 20 mmHg at 45° C. for 12 hours and classified with an air classifier to give the encapsulated toner with an average particle size of 9 μm whose shell is made of a resin having a thermally dissociating urethane linkage. The glass transition point assignable to the resin contained in the core material is 30.2° C., and its softening point is 30.0° C. This toner is referred to as "Toner 1."

Production Example 2 of Encapsulated Toner 367.5 g of bisphenol A propylene oxide adduct, 146.4 g of bisphenol A ethylene oxide adduct, 126.0 g of terephthalic acid, 40.2 g of dodecenylsuccinic anhydride and 77.7 g of trimellitic anhydride are placed in a two-liter four-necked glass flask, and a thermometer, a stainless steel stirring rod, a condenser and a nitrogen inlet tube are attached thereto. The reaction is carried out in a nitrogen stream in a mantle heater at 220° C.

The degree of polymerization is determined based on the softening point measured according to ASTM E28-67, and the reaction is terminated when the softening point reaches 110° C.

When the glass transition point of the obtained resin is measured by a differential scanning calorimeter (manufactured by Seiko Instruments, Inc.), it is 65° C. In addition, its softening point and acid value are measured, and they are, respectively, 110° C. and 18 KOH mg/g. The acid value is measured according to JIS K0070.

To a mixture comprising 69.0 parts by weight of styrene, 31.0 parts by weight of 2-ethylhexyl acrylate and 0.9 parts by weight of divinylbenzene, and 7.0 parts by weight of carbon black "#44" (manufactured by Mitsubishi Kasei Corporation), 20.0 parts by weight of the resin obtained as above and 3.5 parts by weight of 2,2'-azobisisobutyronitrile are added. The obtained mixture is introduced into an attritor (manufactured by Mitsui Miike Kakoki) and dispersed at 10° C. for 5 hours to give a polymerizable composition. This composition is added to 800 g of a 4% by weight aqueous colloidal solution of tricalcium phosphate which had been preliminarily prepared in a 2-liter separable glass flask, so as to give a concentration of 30% by weight. The obtained mixture is emulsified and dispersed with a TK homomixer (manufactured by Tokushu Kika Kogyo) at 5° C. and a rotational speed of 12000 rpm for 5 minutes.

Next, a four-necked glass cap is set on the flask, and a reflux condenser, a thermometer, a nitrogen inlet tube and a stainless steel stirring rod are attached thereto. The resulting flask is placed on an electric mantle heater. Thereafter, the contents are heated to 85° C. and reacted for 10 hours in a nitrogen atmosphere while stirring. After cooling the reaction mixture, the dispersion medium is dissolved into 10%-aqueous hydrochloric acid. The resulting mixture is filtered and the obtained solid is washed with water, dried under a reduced pressure of 20 mmHg at 45° C. for 12 hours and classified with an air classifier to give the encapsulated toner with an average particle size of 8 μm whose shell is made of an amorphous polyester resin.

To 100 parts by weight of the encapsulated toner, 0.4 parts by weight of hydrophobic silica fine powder (Nippon Aerozil Ltd.: R-972) is added and mixed to obtain the encapsulated toner of the present invention. The glass transition point assignable to the resin contained in the core material is 30.6° C., and the softening point of the toner is 125.5° C. This toner is referred to as "Toner 2."

Production Example of Reference Toner

To 100 parts by weight of a polyester resin (Bisphenol-type polyester resin; softening point: 135° C.; Tg: 65° C.), 7 parts by weight of carbon black (manufactured by Mitsubishi Kasei Corporation, MA8), 3 parts by weight of a polypropylene wax (Sanyo Kasei Ltd., Biscol 660P), and 2 parts by weight of a charge control agent (Hodogaya Kagaku Ltd., Aizenspilon Black TRH) are mixed, and the resulting mixture is kneaded by a pressurized kneader. After cooling the obtained mixture, it is pulverized with a pulverizing mill and then classified with a classifier to obtain a toner having a particle distribution range of 5 to 25 μm and an average particle size of 10 μm. To 1 kg of the toner, 5 g of hydrophobic silica fine powder (Nippon Aerozil Ltd.: R-972) is externally added to obtain a surface-treated reference toner.

Test Example 1

50 g of the toner obtained in Production Example 1 of Encapsulated Toner is blended together with 1 kg of a commercially available ferrite carrier by using a V-type blender to obtain a developer 1. The obtained developer 1 is loaded on a commercially available copying machine to develop images without heat-fixing. The fixing ability and the non-offsetting region of the toner of the present invention are measured using the fixing device of the present invention shown in FIG. 7 (endless film made of polyethylene terephthalate; fixing roller diameter: 20 mmϕ; nip pressure: 0.3 kg/cm; a heater manufactured by Ushio Electric Ltd.), while varying the heating temperature at a linear velocity of 20 mm/sec. As for a recording medium, a polyethylene film (manufactured by Ohkura Kogyo Kabushiki Kaisha) having a softening point of 120° C. is used. As a result, the toner in the present invention is sufficiently fixed onto the transparency sheet at a surface temperature of the endless film of 98° C., and it does not show any offsetting to the endless film at a temperature of between 80° C. and 140° C.

On the other hand, the toner obtained by the Production Example of Reference Toner is mixed with a commercially available ferrite carrier to prepare a developer 3. After developing images using a commercially available copying machine in the same manner as above, the fixing ability and the non-offsetting region of the reference toner are measured using the same recording medium and the same the fixing device as above. As a result, the reference toner is fixed onto the transparency sheet at a surface temperature of the endless film of 133° C., and the reference toner does not show any offsetting at a temperature of between 110° C. and 140° C.

Test Example 2

The developer 1 obtained in Test Example 1 is loaded on a commercially available copying machine to develop images without heat-fixing. The fixing ability and the non-offsetting region of the toner of the present invention are measured using the heat roller-type fixing device shown in FIG. 8 (heat roller diameter: 20 mmϕ; nip pressure: 0.3 kg/cm; an aluminum surface of the heat roller being surface-coated with Teflon in a thickness of 20 μm; the fixing roller (pressure roller) being heat-resistant silicone rubber roll), while varying the heating temperature at a linear velocity of 20 mm/sec. The recording medium is the same as the one used in Test Example 1. As a result, the toner in the present invention is sufficiently fixed onto the transparency sheet at a temperature of 95° C., and the toner does not show any offsetting to the endless film at a temperature of between 70° C. and 200° C.

On the other hand, by using the developer 3 obtained in the Test Example 1, developing images are carried out in the same manner as above. After that, the fixing ability and the non-offsetting region of the reference toner are measured using the same fixing device as above. As a result, the reference toner is fixed onto the transparency sheet at a temperature of 130° C., and the reference toner does not show any offsetting at a temperature of between 110° C. and 200° C.

Test Example 3

50 g of the toner obtained in Production Example 2 of Encapsulated Toner is blended together with 1 kg of a commercially available coated ferrite carrier by using a V-type blender to obtain a developer 2. The obtained developer 2 is used to carry out copying by using a fixing device in which a commercially available copying machine is modified as schematically shown in FIG. 9. The recording medium is the same as the one used in Test Example 1. Specifically, a heat-resistant, organic photoconductor is used as a photoconductor, and a quartz heater is used as a heater and arranged at a distance of 3.0 cm away from the point where the photoconductor contacts the pressure roller, almost in parallel with the upper portion of the conveying route of the transparency sheet. In addition, by varying the heating temperature and the conveying velocity, the temperature on the surface of the transparency sheet is properly adjusted so as to preheat the surface of the transparency sheet to a temperature of between 60° C. and 160° C. The pressure roller used in the transfer and fixing is made of silicone rubber having a roller diameter of 30 mmϕ, and transfer and fixing are carried out at a nip pressure of 0.5 kg/cm and a peripheral speed of 40 mm/sec.

As a result, the lowest fixing temperature of the surface of the transparency sheet is 95° C., and substantially no melting of the toner onto the surface of the photoconductor is observed at a temperature of between 80° C. and 140° C.

On the other hand, by using the developer 3 obtained in the Test Example 1, copying is carried out in the same manner as above using the same recording medium and the same modified apparatus as above. As a result, the lowest fixing temperature is 135° C.

The lowest fixing temperature for the toner is the temperature of the surface of the transparency sheet at which the fixing rate of the toner exceeds 70%. This fixing rate of the toner is determined by placing a load of 500 g on a sand-containing rubber eraser having a bottom area of 15 mm×7.5 mm which contacts the fixed toner image, placing the loaded eraser on a fixed toner image obtained in the fixing device, moving the loaded eraser on the image backward and forward five times, measuring the optical reflective density of the eraser-treated image with a reflective densitometer manufactured by Macbeth Co., and then calculating the fixing rate from this density value and a density value before the eraser treatment using the following equation.

$$\text{Fixing rate} = \frac{\text{Image density after eraser treatment}}{\text{Image density before eraser treatment}} \times 100$$

Test Example 4

The fixing devices used in Test Examples 1 through 3 are used to carry out continuous copying test for 3000 sheets. A polypropylene film (manufactured by Sankyo Polyethylene Kabushiki Kaisha) having a softening point of 151° C. is used as a recording medium. In the fixing device for Test Example 1, the linear velocity is adjusted to 20 mm/sec and the preheating temperature to 120° C.; in the fixing device for Test Example 2, the linear velocity is adjusted to 20 mm/sec and the heating temperature of the heat roller to 110° C.; and in the fixing device for Test Example 3, the preheating temperature is adjusted to 120° C. and the peripheral speed of the pressure roller used in the transfer and fixing to 40 mm/sec.

As a result, when the developer 1 or the developer 2 is used, fixing ability is good in either one of the fixing devices, and curling, jamming, etc. of the transparency sheets are not likely to take place.

On the other hand, when the developer 3 is loaded on each of the fixing devices, and continuous copying test is carried out in the same manner as above for several 10 sheets to 100 sheets, in the case of the fixing device used in Test Example 1, the toner is attached to the surface of the endless film, and after copying 20 sheets, spots on the image become quite noticeable. Moreover, the fixed visible image thus obtained is easily removed by rubbing it with a paper. In the case of the fixing device used in Test Example 2, a remarkable deterioration in image quality and cold offsetting take place from the first sheet of copying. Therefore, the copying is terminated after 30 sheets. In the case of the fixing device used in Test Example 3, the spots of the toner on the photoconductor takes place and the deterioration of the visible image gradually progresses. Therefore, the copying test is terminated after 100 sheets. Moreover, the fixed visible image thus obtained is easily removed by rubbing it with a paper.

From these Test Examples, it is confirmed that by utilizing the method of forming fixed images according to the present invention using a thermally dissociating encapsulated toner or an encapsulated toner whose shell is made of amorphous polyester, in the case where a transparency sheet is used as a recording medium, the lowest fixing temperature can be remarkably lowered, thereby remarkably reducing curling or jamming of the transparency sheets fed to the copying machine.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrostatic imaging process comprising:
uniformly charging a photoconductor;
selectively exposing said photoconductor to light so as to form an electrostatic latent image;
providing a shell-encapsulated toner which shell becomes fragile upon exposure to heat within a temperature range of not less than 80° C. and not more than 120° C.;
developing said electrostatic latent image with said shell-encapsulated toner, to form a visible toner image;
transferring said formed visible toner image to a recording medium having a softening point of from 100° to 200° C.;
preheating said shell-encapsulated toner by a heat source to a temperature of not less than 80° C. and not more than 120° C. making said shell of said toner fragile through an endless film, said endless film being positioned between said heat source and said recording medium, adjacent to but apart from said toner image on said recording medium; and
fixing said transferred visible toner image onto said recording medium by pressing said toner onto said recording medium by a fixing roller which exerts a nip pressure of from 0.1 to 4 kg/cm.

2. The method according to claim 1, wherein said recording medium is selected from at least one member of the group consisting of a polyethylene film, a polypropylene film, cellophane and a polymethylpentene film.

3. The method according to claim 1, wherein a heat source for heating said encapsulated toner is a heat roller.

4. The method according to claim 1, wherein said shell of said shell-encapsulated toner is thermally dissociating and comprises a heat-fusible resinous core material containing at least a coloring agent and said shell formed thereon so as to cover a surface of the said core material, wherein a main component of said shell is a resin prepared by reacting:

(A) an isocyanate and/or isothiocyanate compound comprising:
(1) 0 to 30 mol % of a monovalent isocyanate and/or isothiocyanate compounds, and
(2) 100 to 70 mol % of at least a divalent isocyanate and/or isothiocyanate compounds with (B) an active hydrogen compound comprising:
(3) 0 to 30 mol % of a compound having one active hydrogen atom reactive with isocyanate and/or isothiocyanate groups and
(4) 100 to 70 mol % of a compound having at least two active hydrogen atoms reactive with isocyanate and/or isothiocyanate groups at a molar ratio of the component (A) to the component (B) of between 1:1 and 1:20, and wherein at least 30% of all of the linkages formed from the isocyanate or isothiocyanate groups are thermally dissociating linkages.

5. The method according to claim 4, wherein said thermally dissociating linkages are linkages derived from reacting phenolic hydroxyl and/or thiol groups with said isocyanate and/or isothiocyanate groups.

6. The method according to claim 4, wherein said heat-fusible core material comprises a thermoplastic resin as its main component, having a glass transition point of from 10° C. to 50° C.

7. The method according to claim 4, wherein said thermally dissociating shell-encapsulated toner has a softening point of from 80° C. to 150° C.

8. The method according to claim 1, wherein said encapsulated toner comprises a shell made of an amorphous polyester.

9. The method according to claim 8, wherein said amorphous polyester has a glass transition point of from 50° C. to 80° C.

10. The method according to claim 8, wherein said amorphous polyester is obtained by condensation polymerization between at least one alcohol monomer selected from the group consisting of dihydric alcohol monomers and trihydric or higher polyhydric alcohol monomers and at least one carboxylic acid monomer selected from the group consisting of dicarboxylic acid monomers and tricarboxylic or higher carboxylic acid monomers.

11. An electrostatic imaging process comprising:
uniformly charging a photoconductor;
selectively exposing said photoconductor to light so as to form an electrostatic latent image;
providing a shell-encapsulated toner which shell becomes fragile upon exposure to heat within a temperature range of not less than 80° C. and not more than 120° C.;
developing said electrostatic latent image with said shell-encapsulated toner, to form a visible toner image;
preheating a recording medium having a softening point of from 100° to 200° C., to a temperature of from 60° to 160° C.; and
substantially simultaneously transferring said visible toner image to said preheated recording medium and fixing said transferred toner image to said recording medium by pressing said toner image on said recording medium by a fixing roller exerting a nip pressure of from 0.1 to 4 kg/cm.

* * * * *